US008863685B2

(12) United States Patent
Mori et al.

(10) Patent No.: US 8,863,685 B2
(45) Date of Patent: Oct. 21, 2014

(54) DEVICE FOR CONVEYING HONEYCOMB STRUCTURAL BODY, METHOD FOR SEALING HONEYCOMB STRUCTURAL BODY, AND METHOD FOR PRODUCING HONEYCOMB STRUCTURAL BODY

(75) Inventors: Masaharu Mori, Niihama (JP); Ying Gong, Niihama (JP)

(73) Assignee: Sumitomo Chemical Company, Limited, Tokyo (JP)

( * ) Notice: Subject to any disclaimer, the term of this patent is extended or adjusted under 35 U.S.C. 154(b) by 0 days.

(21) Appl. No.: 13/640,656

(22) PCT Filed: Nov. 8, 2011

(86) PCT No.: PCT/JP2011/075746

§ 371 (c)(1),
(2), (4) Date: Oct. 11, 2012

(87) PCT Pub. No.: WO2012/077449

PCT Pub. Date: Jun. 14, 2012

(65) Prior Publication Data

US 2013/0243952 A1 Sep. 19, 2013

(30) Foreign Application Priority Data

Dec. 7, 2010 (JP) ..... 2010-272770

(51) Int. Cl.
*B05C 13/02* (2006.01)
*B05D 7/22* (2006.01)
*B28B 11/00* (2006.01)

(52) U.S. Cl.
CPC ..... *B05C 13/025* (2013.01); *B05D 7/222* (2013.01); *B28B 11/007* (2013.01); *Y10S 901/31* (2013.01); *Y10S 901/47* (2013.01)
USPC ..... 118/66; 118/317; 118/400; 118/407; 118/408; 118/410; 118/411; 118/429; 198/346.2; 198/468.2; 198/468.4; 198/468.6; 198/470.1; 414/729; 414/739; 414/744.3; 414/744.5; 414/744.7; 414/744.8; 427/8; 427/230; 427/231; 427/238; 427/294; 427/295; 700/245; 901/31; 901/47

(58) Field of Classification Search
USPC ..... 118/66, 317, 400, 407, 408, 410, 411, 118/429; 198/346.2, 468.2, 468.4, 468.6, 198/470.1; 414/729, 739, 744.3, 744.5, 414/744.7, 744.8; 427/8, 230, 231, 238, 427/294, 295; 700/245; 901/31, 47
See application file for complete search history.

(56) References Cited

U.S. PATENT DOCUMENTS

| | | | | |
|---|---|---|---|---|
| 4,293,357 | A | 10/1981 | Higuchi et al. | |
| 4,402,053 | A * | 8/1983 | Kelley et al. | 700/259 |
| 4,550,034 | A * | 10/1985 | Shimrock et al. | 427/243 |
| 4,609,563 | A * | 9/1986 | Shimrock et al. | 427/8 |
| 4,663,658 | A * | 5/1987 | Lanne et al. | 348/95 |
| 5,523,663 | A * | 6/1996 | Tsuge et al. | 318/568.16 |
| 6,478,874 | B1 * | 11/2002 | Rosynsky et al. | 118/63 |
| 7,043,964 | B1 * | 5/2006 | Hickman | 73/40.7 |
| 7,313,464 | B1 * | 12/2007 | Perreault et al. | 700/245 |
| 7,374,792 | B2 * | 5/2008 | Rosynsky et al. | 427/231 |
| 7,520,918 | B2 * | 4/2009 | Zoeller, III | 95/273 |
| 7,521,087 | B2 * | 4/2009 | Rosynsky et al. | 427/231 |
| 8,290,618 | B2 * | 10/2012 | Demopoulos | 700/245 |
| 8,491,966 | B2 * | 7/2013 | Hasselmann | 427/282 |
| 2003/0003232 | A1 * | 1/2003 | Rosynsky et al. | 427/294 |
| 2006/0151926 | A1 * | 7/2006 | Zoeller, III | 264/603 |
| 2007/0114700 | A1 | 5/2007 | Andrewlavage, Jr. et al. | |
| 2008/0145531 | A1 * | 6/2008 | Rosynsky et al. | 427/231 |
| 2011/0268624 | A1 * | 11/2011 | Chandler et al. | 422/222 |

FOREIGN PATENT DOCUMENTS

| | | | |
|---|---|---|---|
| EP | 1180485 | A1 | 2/2002 |
| JP | 63-24731 | A | 5/1988 |
| JP | 2002-18759 | A | 1/2002 |
| JP | 2008-55347 | A | 3/2008 |
| JP | 2009-6628 | A | 1/2009 |
| WO | WO 2004/091786 | A1 * | 10/2004 |
| WO | 2006/069006 | A2 | 6/2006 |
| WO | WO 2008/113801 | A1 * | 9/2008 |
| WO | 2012/105420 | A1 | 8/2012 |
| WO | 2012/105421 | A1 | 8/2012 |

OTHER PUBLICATIONS

International Preliminary Report on Patentability for PCT/JP2011/075746, Jun. 12, 2013, 5 pages.*

International Preliminary Report on Patentability and Written Opinion mailed Jun. 20, 2013 in International Application No. PCT/JP2011/075746 to Sumitomo Chemical Co., Ltd.

Extended European Search Report issued Aug. 7, 2013 in counterpart European Patent Application No. 11847681.1.

* cited by examiner

*Primary Examiner* — William Phillip Fletcher, III
(74) *Attorney, Agent, or Firm* — Sughrue Mion, PLLC

(57) ABSTRACT

A camera is used to take an image of an end surface of a honeycomb structure gripped by a hand. Based on the image, an initial rotation angle of the honeycomb structure around a vertical axis at a reference position where the image has been taken is recognized. An arm turning section is driven to convey the honeycomb structure gripped by the hand from the reference position to above a plugging mask. A rotation angle required to adjust the rotation angle of the honeycomb structure on the plugging mask to a desired final rotation angle is acquired based on the initial rotation angle recognized at the reference position and a rotation angle of the honeycomb structure around the vertical axis associated with the driving of the arm turning section from the reference position to above the plugging mask. The honeycomb structure is rotated based on the required rotation angle.

11 Claims, 6 Drawing Sheets

Replacement Drawing Sheet

DEVICE FOR CONVEYING HONEYCOMB STRUCTURAL BODY, METHOD FOR SEALING HONEYCOMB STRUCTURAL BODY, AND METHOD FOR PRODUCING HONEYCOMB STRUCTURAL BODY

CROSS REFERENCE TO RELATED APPLICATIONS

This application is a National Stage of International Application No. PCT/JP2011/075746, filed on Nov. 8, 2011, which claims priority from Japanese Patent Application No. 2010-272770, filed on Dec. 7, 2010, the contents of all of which are incorporated herein by reference in their entirety.

TECHNICAL FIELD

The present invention relates to a conveying apparatus for a honeycomb structure, a method for plugging the honeycomb structure, and a method for manufacturing the honeycomb structure.

BACKGROUND ART

A honeycomb filter for use as a diesel particulate filter (DPF) or the like has been widely known. The honeycomb filter is configured such that one end of each of some of a large number of through-holes in a honeycomb structure is plugged with a plugging material, while the other end of each of the remaining through-holes is plugged with the plugging material. Patent Literature 1 discloses a method for manufacturing such a honeycomb filter. According to the method described in Patent Literature 1, a piston 8 is used to press a plugging material into through-holes at one end surface of a honeycomb structure 1 arranged in a cylinder 7, via a plugging mask with through-holes corresponding to positions which are to be plugged. Thus, the plugging material is fed to the ends of desired through-holes in the honeycomb structure.

CITATION LIST

Patent Literature

Patent Literature 1: Japanese Patent Publication No. 63-24731

SUMMARY OF INVENTION

Technical Problem

Each of the through-holes in the honeycomb structure has a small diameter. The diameter of each of the through-holes in the plugging mask is comparable to the diameter of each of the through-holes in the honeycomb structure. Thus, when the through-holes in the honeycomb structure are correctly superimposed on the through-holes in the mask, it is difficult to view the contour of an outer wall of the honeycomb structure and the contour of the through-holes through the openings in the plugging mask. Thus, aligning the through-holes in the honeycomb structure with the through-holes in the plugging mask is conventionally very difficult.

The present invention has been developed in view of the above-described problems. An object of the present invention is to provide a conveying apparatus for a honeycomb structure which allows the through-holes in the honeycomb structure to be accurately aligned with the through-holes in the plugging mask, a method for plugging the honeycomb structure, and a method for manufacturing the honeycomb structure.

Solution to Problem

A conveying apparatus for a honeycomb structure according to an aspect of the present invention includes a hand that is capable of gripping the columnar honeycomb structure arranged in a vertical direction, an arm that holds the hand at an end thereof, an arm turning section that turns the arm around at least one vertical axis, a hand rotating section that rotates the hand around the vertical axis with respect to the arm, a camera that takes an image of an end surface of the honeycomb structure gripped by the hand, an initial rotation angle recognizing section that recognizes, based on the image in the camera, an initial rotation angle of the honeycomb structure around the vertical axis at a reference position where the image has been taken, an arm turning control section that drives the arm turning section to convey the honeycomb structure gripped by the hand from the reference position to above the plugging mask, a required rotation angle acquiring section that acquires a hand rotation angle required to adjust the rotation angle of the honeycomb structure on the plugging mask to a desired final rotation angle based on the initial rotation angle recognized at the reference position and a conveying rotation angle of the honeycomb structure around the vertical axis associated with the driving of the arm turning section from the reference position to above the plugging mask, and a hand rotation control section that drives the hand rotating section based on the required hand rotation angle to rotate the honeycomb structure.

According to the conveying apparatus for the honeycomb structure, the gripped honeycomb structure can be arranged on the plugging mask at a desired rotation angle. Thus, the plugging mask can be easily aligned with the honeycomb structure.

According to the conveying apparatus for the honeycomb structure, the arm may include a first arm that is capable of turning around the vertical axis and a second arm that is capable of turning around the vertical axis with respect to the first arm, and the arm turning section may turn the first arm and the second arm. Thus, the hand can be more freely moved.

According to the conveying apparatus for the honeycomb structure, the camera may take an image of a lower end surface of the honeycomb structure. This allows an image of the end surface to be easily taken with the honeycomb structure remaining gripped by the hand. Thus, the present invention increases angle detection accuracy and alignment accuracy compared to the case in which the honeycomb structure is released from the hand, subjected to image taking, then gripped by the hand again.

A method for plugging a honeycomb structure according to an aspect of the present invention includes a step of allowing a hand provided at an end of an arm to grip the columnar honeycomb structure arranged in a vertical direction, a step of taking an image of an end surface of the honeycomb structure gripped by the hand, a step of recognizing, based on the image, an initial rotation angle of the honeycomb structure around a vertical axis at a reference position where the image has been taken, a step of turning the arm around at least one vertical axis to convey the honeycomb structure gripped by the hand from the reference position to above a plugging mask, a step of acquiring a hand rotation angle required to adjust the rotation angle of the honeycomb structure on the plugging mask to a desired final rotation angle based on the initial rotation angle recognized at the reference position and a conveying rotation angle of the honeycomb structure around the vertical axis associated with the conveyance from the reference position to above the plugging mask, a step of rotating the hand with respect to the arm based on the required hand rotation angle, a step of loading the honeycomb structure conveyed to above the plugging mask onto the plugging mask after the rotation of the hand, and a step of feeding a plugging material to the honeycomb structure via the loaded plugging mask.

A method for manufacturing a honeycomb structure according to an aspect of the present invention includes a step of arranging the columnar honeycomb structure with at least one through-hole in a vertical direction, a step of allowing a hand provided at an end of an arm to grip the honeycomb structure arranged in a vertical direction, a step of taking an image of an end surface of the honeycomb structure gripped by the hand, a step of recognizing, based on the image, an initial rotation angle of the honeycomb structure around a vertical axis at a reference position where the image has been taken, a step of turning the arm around at least one vertical axis to convey the honeycomb structure gripped by the hand from the reference position to above a plugging mask, a step of acquiring a hand rotation angle required to adjust the rotation angle of the honeycomb structure on the plugging mask to a desired final rotation angle based on the initial rotation angle recognized at the reference position and a conveying rotation angle of the honeycomb structure around the vertical axis associated with the conveyance from the reference position to above the plugging mask, a step of rotating the hand with respect to the arm based on the hand rotation angle, a step of loading the honeycomb structure conveyed to above the plugging mask onto the plugging mask after the rotation of the hand, a step of feeding a plugging material to the honeycomb structure via the loaded plugging mask, and a step of drying the honeycomb structure.

According to the method for manufacturing the honeycomb structure, in the step of acquiring the hand rotation angle, the hand rotation angle may be acquired based on a difference between the desired final rotation angle and a combined value of the initial rotation angle and the conveying rotation angle.

According to the method for manufacturing the honeycomb structure, in the step of feeding the plugging material, the plugging material may be fed exclusively to though-holes which lie opposite the holes in the plugging mask, of the plurality of through-holes in the honeycomb structure.

According to the method for manufacturing the honeycomb structure, the step of rotating the hand may be carried out after the step of conveying the honeycomb structure to above the plugging mask. The step of rotating the hand may be carried out during the step of conveying the honeycomb structure to above the plugging mask. Alternatively, the step of rotating the hand may be carried out before the step of conveying the honeycomb structure to above the plugging mask.

According to the method for manufacturing the honeycomb structure, in the step of arrangement, the unbaked honeycomb structure is arranged in the vertical direction, and in the step of drying, the unbaked honeycomb structure may be baked.

Advantageous Effects of Invention

According to the conveying apparatus for the honeycomb structure, the method for plugging the honeycomb structure, and the method for manufacturing the honeycomb structure as described above, the through-holes in the honeycomb structure can be accurately aligned with the through-holes in the plugging mask. An image of the end surface of the honeycomb structure is taken with the honeycomb structure remaining gripped by the hand, and the honeycomb structure remaining gripped by the hand is moved to the plugging portion. This enables a reduction in time required for the steps.

DESCRIPTION OF EMBODIMENTS

Preferred embodiments of a conveying apparatus for a honeycomb structure, a method for plugging the honeycomb structure, and a method for manufacturing the honeycomb structure will be described below in detail with reference to the drawings.

First, a honeycomb structure 70 to be conveyed will be described.

Figure 1:
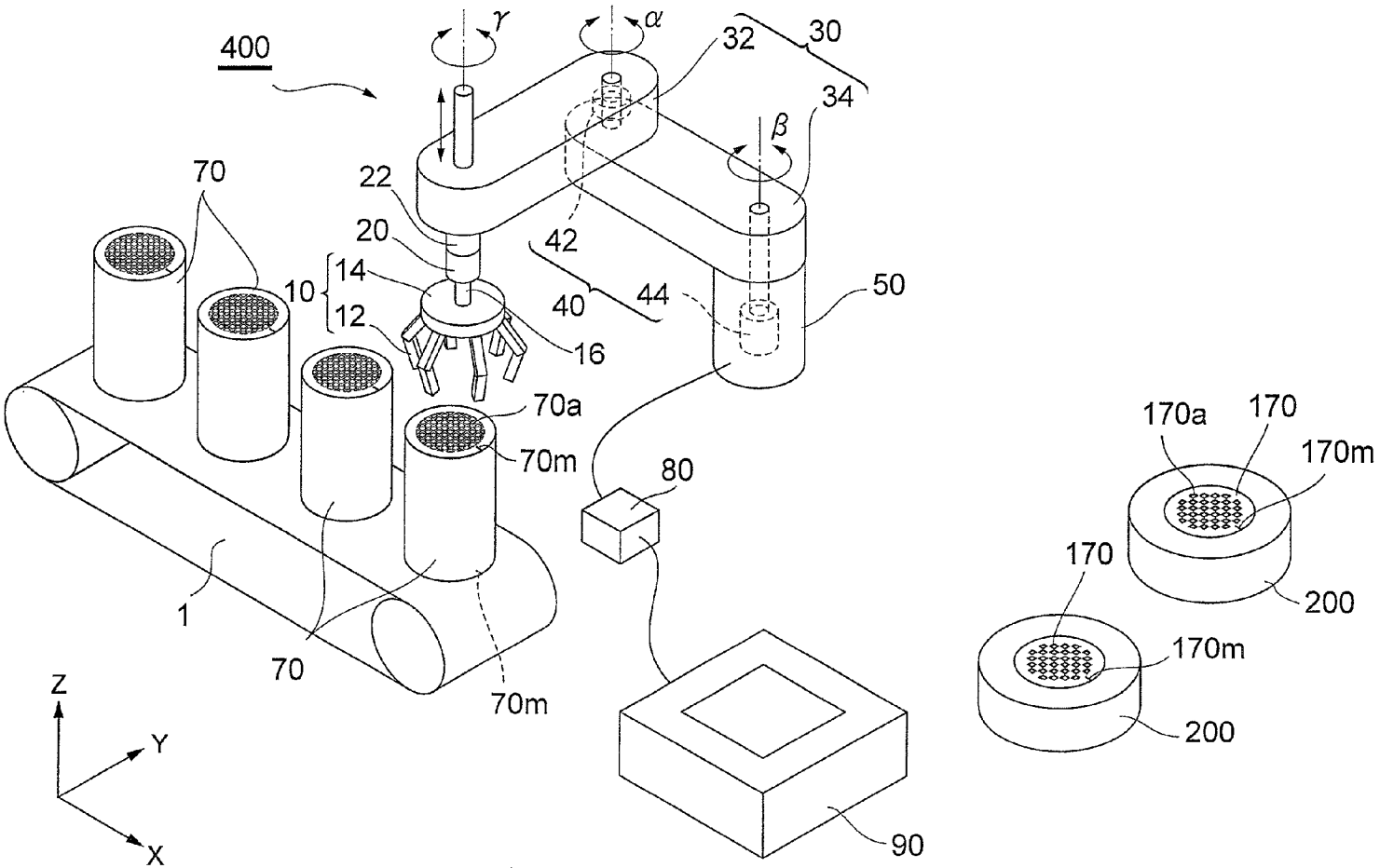
FIG. 1 is a schematic perspective view showing a conveying apparatus, a feeding apparatus, and a plugging apparatus according to an embodiment.

The honeycomb structure 70 according to the present embodiment is shaped like a column with a large number of through-holes 70*a* extending in a vertical direction and including an opening in both upper and lower end surfaces of the honeycomb structure 70 as shown in FIG. 1. The external shape of the honeycomb structure 70 is not particularly limited. The external shape of the honeycomb structure 70 may be, for example, a cylinder, an elliptic cylinder, a polygonal column (for example, a regular polygonal column such as a regular triangular prism, a square cylinder, a regular hexagonal cylinder, or a regular octagonal cylinder, or a polygonal column other than the regular polygonal columns, such as a triangular prism, a quadrangular prism, a hexagonal cylinder, or an octagonal cylinder). The cross-sectional shape of each of the through-holes 70*a* is not particularly limited. The cross-sectional shape of each of the through-hole 70*a* may be a polygon such as a circle, an ellipse, a square, a rectangle, a triangle, or a hexagon. The through-holes 70*a* may include those having different diameters or those having different cross-sectional shapes.

The form of arrangement of the through-holes 70*a* as seen from the upper or lower end surface of the honeycomb structure 70 is not particularly limited. The form of arrangement of the through-holes 70*a* may be, for example, a square arrangement in which the central axes of the through-holes 70*a* are positioned at the respective vertices of squares or a regular triangular arrangement in which the central axes of the through-holes 70*a* are arranged at the vertices of a regular triangle. The diameter of each of the through-holes 70*a* is not particularly limited. The diameter of the through-hole 70*a* may be such that for example, if the cross section is square, each side of the square is between 0.8 mm and 2.5 mm. A thickness of a partition wall that separates the through-holes 70*a* from each other is, for example, between 0.15 mm and 0.76 mm.

The length of the honeycomb structure 70 in a direction in which the through-hole 70*a* extends (the total length of the through-hole 70*a* in the vertical direction) is not particularly limited. The length in the direction in which the through-hole 70*a* extends may be, for example, between 40 mm and 350 mm. The outer diameter of the honeycomb structure 70 is not particularly limited. The outer diameter of the honeycomb structure 70 may be, for example, between 100 mm and 320 mm.

The honeycomb structure 70 is preferably a green body (unbaked body) that is converted into ceramics when subsequently baked, and particularly preferably a green body that is converted into porous ceramics when subsequently baked. The ceramics are not particularly limited. Examples of the ceramics include oxides such as aluminum oxide (alumina), silicon dioxide (silica), mullite, cordierite, glass, and aluminum titanate, silicon carbide, silicon nitride, and metal. The aluminum titanate may further contain magnesium and/or silicon. The honeycomb structure 70 may be sintered ceramics.

Now, a conveying apparatus 400 for the honeycomb structure will be described.

The conveying apparatus 400 is provided adjacent to a feeding apparatus 1 and a plugging apparatus 200. The feeding apparatus 1 feeds the honeycomb structure 70 to the conveying apparatus 400. The conveying apparatus 400 loads the honeycomb structure 70 fed by the feeding apparatus 1 onto a plugging mask 170 on the plugging apparatus 200 at a specified angle of rotation. The plugging apparatus 200 feeds the plugging material to one end surface of the honeycomb structure 70. According to the present embodiment, two plugging apparatuses 200 are provided in juxtaposition around the conveying apparatus 400. The conveying apparatus 400 according to the present embodiment is a robotic conveying system.

The conveying apparatus 400 mainly includes a hand 10, an arm 30, an arm turning section 40, a hand rotating section 20, a hand lifting and lowering section 22, a camera 90, and a controller 80.

The hand 10 includes a base section 14 and a gripping member 12 fixed to the base section 14. The gripping member 12 grips the columnar honeycomb structure 70 arranged along the vertical direction so as to retain this direction. Specifically, for example, the gripping member 12 can grip the upper portion of side surface of the honeycomb structure 70 using a plurality of finger members. A vertical rotating shaft 16 is connected to the hand 10.

The arm 30 includes a second arm 32 and a first arm 34. The hand 10 is fixed to one end of the second arm 32 via the hand rotating section 20. The hand rotating section 20 rotates the hand 10 around the vertical rotating shaft 16 with respect to the second arm 32.

The vertical rotating shaft 16 further includes the hand lifting and lowering section 22 that moves the vertical rotating shaft 16 up and down.

The other end of the second arm 32 is connected to one end of the first arm 34 by a second arm turning section 42. The second arm turning section 42 turns the second arm 32 around the vertical axis with respect to the first arm 34.

The other end of the first arm 34 is connected to a base 50 by a first arm turning section 44. The first arm turning section 44 turns the first arm 34 around the vertical axis with respect to the base 50.

The second arm turning section 42 and the first arm turning section 44 form the arm turning section 40.

The camera 90 is located at a position where the camera 90 can take an image of an end surface of the hand 10 gripping the honeycomb structure 70. Preferably, the camera 90 is located at a position where the camera 90 can take an image of a lower end surface of the hand 10 gripping the honeycomb structure 70.

Figure 2:
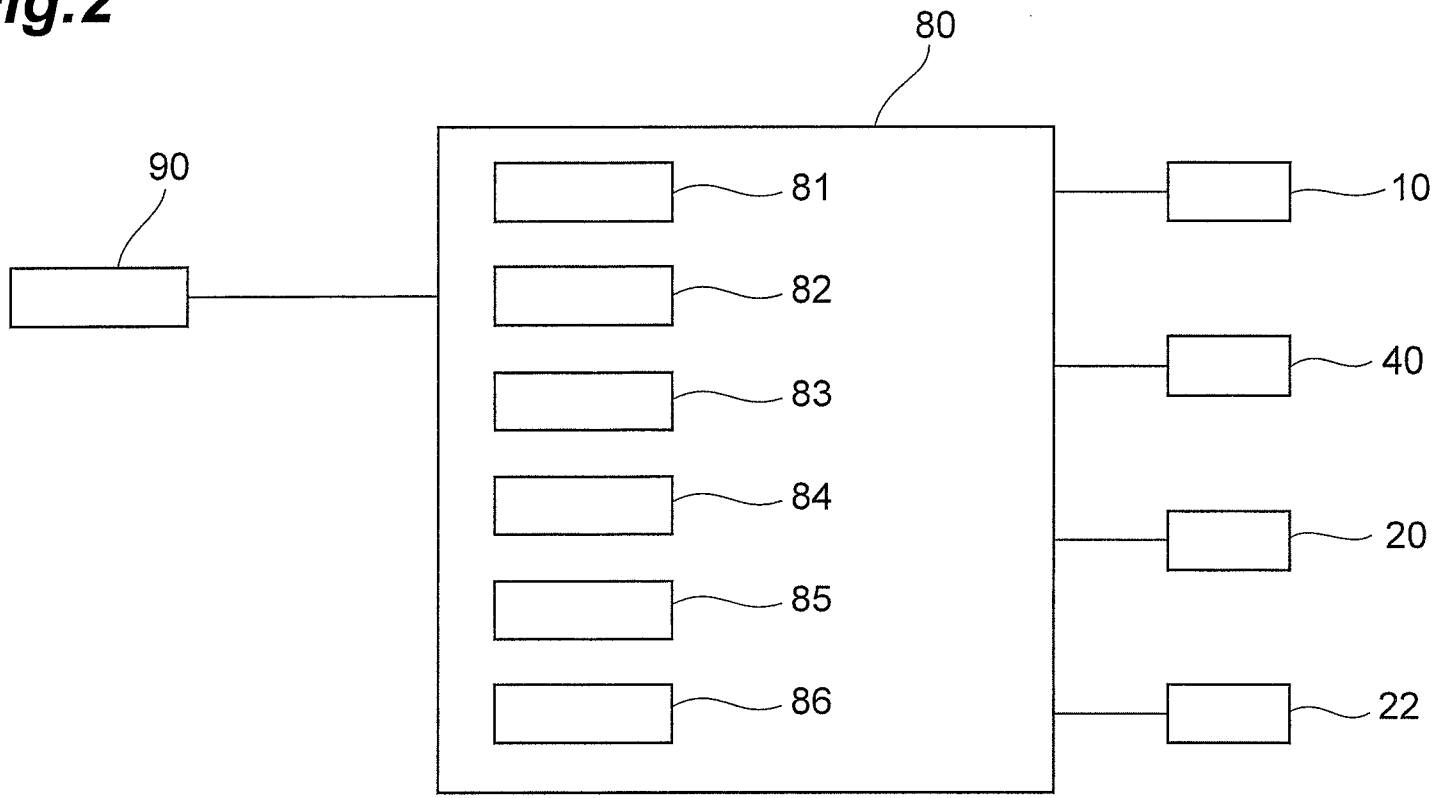
FIG. 2 is a block diagram showing a configuration of a controller and peripheral sections thereof in FIG. 1.

As shown in FIG. 2, the controller 80 is connected to the hand 10, the arm turning section 40, the hand rotating section 20, the hand lifting and lowering section 22, and the camera 90. The controller 80 is normally formed with a computer and can provide the following functions.

A gripping and initial movement section 81 drives the arm turning section 40 and the hand 10 to grip the honeycomb structure 70 fed by the feeding apparatus 1. Then, the gripping and initial movement section 81 conveys the honeycomb structure 70 to a position above the camera 90 (this position is hereinafter sometimes referred to as a reference position).

An initial rotation angle recognizing section 82 takes an image of the end surface of the honeycomb structure 70 using the camera 90. Based on the image taken by the camera 90, the initial rotation angle recognizing section 82 recognizes the initial rotation angle θ of the honeycomb structure 70 gripped by the hand 10, around the vertical axis at the reference position where the image has been taken.

Figure 3:
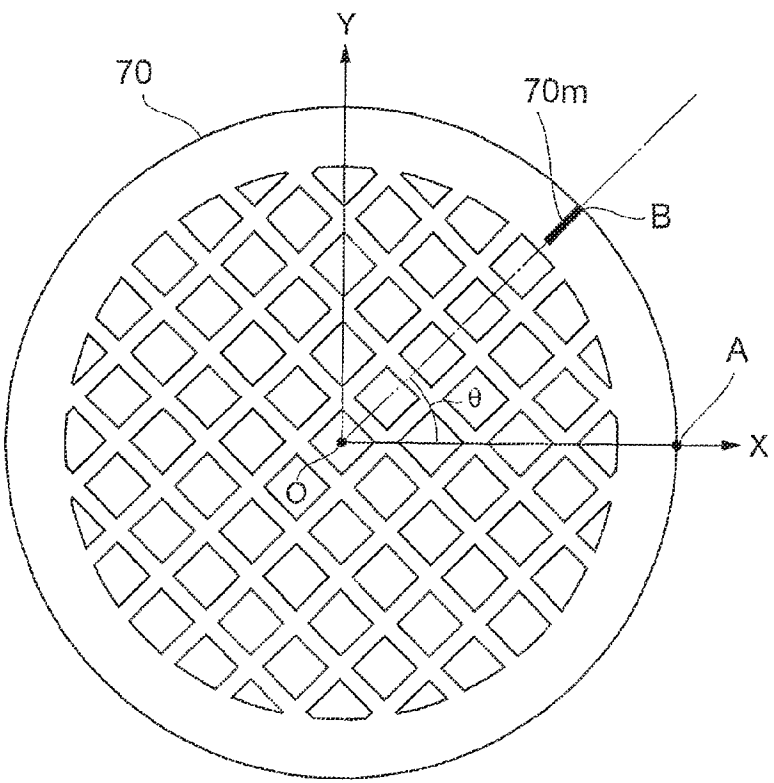
FIG. 3(*a*) is a top view showing a rotating state of a honeycomb structure 70 which corresponds to a reference, and FIG. 3(*b*) is a top view showing that the honeycomb structure 70 is rotated by an angle θ.

The rotation angle refers to through what angle the honeycomb structure 70 has rotated around the center of rotation with respect to the reference rotating state around the vertical axis. For example, the state in FIG. 3(*a*) is assumed to be the reference rotating state of the honeycomb structure 70. To allow the rotating state to be easily determined, a mark 70*m* (or an orientation flat (OF)) is provided on a peripheral portion of the honeycomb structure 70. Then, the reference rotating state is defined as a state in which the mark 70*m* is located an X axis passing through the center of rotation O. If the mark 70*m* on the honeycomb structure 70 is located at a position B as shown in FIG. 3(*b*), the rotation angle θ may be defined as the angle between the X axis and a straight line joining the center O and the position B together. The initial rotation angle θ is the rotation angle corresponding to the reference position above the camera 90.

A well-known image processing method may be used as a method for recognizing the initial rotation angle θ based on the image from the camera 90. The method is not particularly limited. For example, the mark 70*m* is pre-provided, for example, on the peripheral portion of the end surface of the honeycomb structure 70. The mark 70*m* and the center of rotation O are extracted from the image. Then, the initial rotation angle θ with respect to the predefined reference state can be acquired based on the angle between the line joining the mark 70*m* and the center of rotation O together and the reference direction, for example, the X axis. The following method is also possible. A mark 70*n* is provided opposite the mark 70*m* across the center of rotation O. The initial rotation angle θ is determined based on the angle between the reference direction and a line joining the marks 70*m* and 70*n* together.

The initial rotation angle θ can be obtained without the mark 70*m*. For example, if the honeycomb structure 70 has a non-circular external shape such as a rectangle, the contour of the honeycomb structure 70 is extracted by image processing. Then, the initial rotation angle θ can be determined based on, for example, a line joining vertices. Or, for example, the direction in which the through-holes 70*a* are arranged in the honeycomb structure 70 is recognized by image processing. Then, based on the angle between the recognized direction and the X axis, the initial rotation angle θ of the honeycomb structure 70 can be recognized.

The arm turning control section 83 drives the arm turning section 40 to convey the honeycomb structure 70 gripped by the hand 10, from the reference position (above the camera) to above the plugging mask 170. Specifically, the relative positional relationship between the reference position and the position of the plugging mask 170 is previously known, and thus the above-described conveyance can be easily carried out by appropriately setting turning angles α and β for the second arm turning section 42 and the first arm turning section 44. That is, it is easy to align the honeycomb structure 70 and the plugging mask 170 with each other at a position in the XY direction that is other than the position corresponding to the rotation angle.

The required rotation angle acquiring section 84 acquires a rotation angle required to set the final rotation angle of the honeycomb structure above the plugging mask 170 to the desired value. At this time, the rotation angle is acquired based on the initial rotation angle θ recognized at the reference position and the rotation angle (α and β) of the honeycomb structure 70 around the vertical axis associated with the driving of the arm turning section from the reference position to above the plugging mask.

It is assumed that as shown in FIG. 1, the plugging mask 170 includes a mark 170*m* in a peripheral portion thereof and that the final rotation angle of the honeycomb structure 70 above the plugging mask 170 needs to be adjusted such that the mark 170*m* aligns with the mark 70*m* on the honeycomb structure 70. A rotation angle similar to the rotation angle of the honeycomb structure 70 may be set for the plugging mask 170. Here, the rotation angle of the plugging mask 170 set in the plugging apparatus 200 is denoted by ϕ. In this case, the final rotation angle at which the honeycomb structure 70 is to finally be set is the angle ϕ.

The initial rotation angle of the honeycomb structure 70 at the reference position above the camera 90 is denoted by θ. The turning angle of the second arm turning section 42 driven by the arm turning control section 83 is denoted by α. The turning angle of the first arm turning section 44 by the first arm turning section 44 is denoted by β. The sum of the turning angles α and β is equal to a conveying rotation angle. The conveying rotation angle refers to the angle of the honeycomb structure 70 around the vertical axis associated with the conveyance from the reference position to above the plugging mask 170.

When the second arm 32 turns through the turning angle α, the honeycomb structure 70 fixed at a tip of the second arm 32 turns around the vertical axis (central axis) through the angle α in conjunction with the turning of the second arm 32. When the first arm 34 turns through the turning angle β, the honeycomb structure 70 further rotates through the angle β in conjunction with the turning of the first arm 34.

Thus, the conveyance from the reference position above the camera 90 to above the plugging mask 170 changes the rotation angle of the honeycomb structure 70 from the initial rotation angle θ by the conveying rotation angle (α+β). With the initial rotation angle θ and the final rotation angle ϕ taken into account, the hand 10 needs to be rotated through a hand rotation angle γ in order to adjust the rotation angle of the honeycomb structure 70 on the plugging mask 170 to the desired final rotation angle ϕ. The hand rotation angle γ is ϕ−(θ+α+β). That is, the hand rotation angle γ is acquired based on the difference between the final rotation angle ϕ and the combined value of the initial rotation angle θ and the conveying rotation angle (α+β).

A hand rotation control section 85 drives the hand rotating section 20 based on the required hand rotation angle γ to rotate the honeycomb structure 70.

A post-process instructing section 86 drives the hand lifting and lowering section 22 and the hand 10 after the hand 10 is rotated by the hand rotation control section 85, to lower the honeycomb structure 70 located above the plugging mask 170 onto the plugging mask 170. Then, the honeycomb structure 70 is released from the hand 10 and loaded onto the plugging mask 170. The honeycomb structure 70 may remain gripped by the hand 10 instead of being released from the hand 10.

Now, an example of the plugging apparatus 200 will be described with reference to FIG. 4.

The plugging apparatus 200 according to the present embodiment mainly includes a main body portion 210, an elastic plate 220, and a pump 250.

The main body portion 210 is a rigid member formed of metal (for example, a stainless steel material), a polymer material (for example, fiber reinforced plastic), or the like. A recess portion 210*d* is formed in the main body portion 210. A porous member 210*p* is applied to an inner surface of the recess portion 210*d*.

The elastic plate 220 is arranged on the main body portion 210 so as to cover an opening surface of the recess portion 210*d*. The elastic plate 220 is elastic and easily deformable. The elastic plate 220 is preferably, for example, a rubber plate.

The elastic plate 220 is fixed to the main body portion 210 by a ring member 225. The ring member 225 includes an opening 225*a* at a position corresponding to the recess portion 210*d* of the main body portion 210, and is thus shaped like a ring. The ring member 225 is arranged on the elastic plate 220 so as to expose a central portion of the elastic plate 220 (the portion opposite to the recess portion 210*d*).

The main body portion 210 further includes a communication passage 210*e* that communicates with the porous member 210*p* on the bottom surface of the recess portion 210*d*. The communication passage 210*e* is connected to the pump 250.

The pump 250 includes a cylinder 251 and a piston 253 arranged in the cylinder 251. The piston 253 is connected to a motor 255 that reciprocates the piston 253 in an axial direction.

According to the present embodiment, a closed space V is formed between the elastic plate 220 and the piston 253. The closed space V is formed by the main body portion 210, the communication passage 210*e*, and the cylinder 251. The closed space V is filled with a fluid FL such as a liquid.

The plugging apparatus 200 moves the piston 253 to discharge the fluid FL from the interior of the recess portion 210*d* of the main body portion 210. The elastic plate 220 thus comes into tight contact with the inner surface of the recess portion 210*d* to form a recess portion 220*d* of the elastic plate 220 (as shown in FIG. 4(*a*)). Feeding the fluid FL into the recess portion 210*d* separates the elastic plate 220 from the bottom of the recess portion 210*d* (as shown in FIG. 4(*b*)).

Now, a method for manufacturing a honeycomb filter according to the present embodiment will be described.

First, the plugging apparatus 200 is prepared. Specifically, as shown in FIG. 4(*a*), the piston 253 is lowered to form the recess portion 220*d* of the elastic plate 220. A plugging paste P is stored in the recess portion 220*d*.

Subsequently, the plugging mask 170 is placed on the recess portion 210*d* of the main body portion 210. Holes 170*a* in the plugging mask 170 need to be positioned with respect to the honeycomb structure 70 so as to lie opposite to only those of the through-holes 70*a* of the ceramics honeycomb structure 70 which are to be plugged. According to the present embodiment, as shown in FIG. 1, the plugging mask 170 includes a mark 170*m* in an outer peripheral portion thereof. The mark 170*m* is, for example, an orientation flat.

Then, once the preparation of the plugging apparatus 200 is completed, the feeding apparatus 1 conveys the honeycomb structures 70 to the vicinity of the conveying apparatus 400 as shown in FIG. 1. At this time, the conveyed honeycomb structures 70 normally have different rotation angles.

Figure 5:
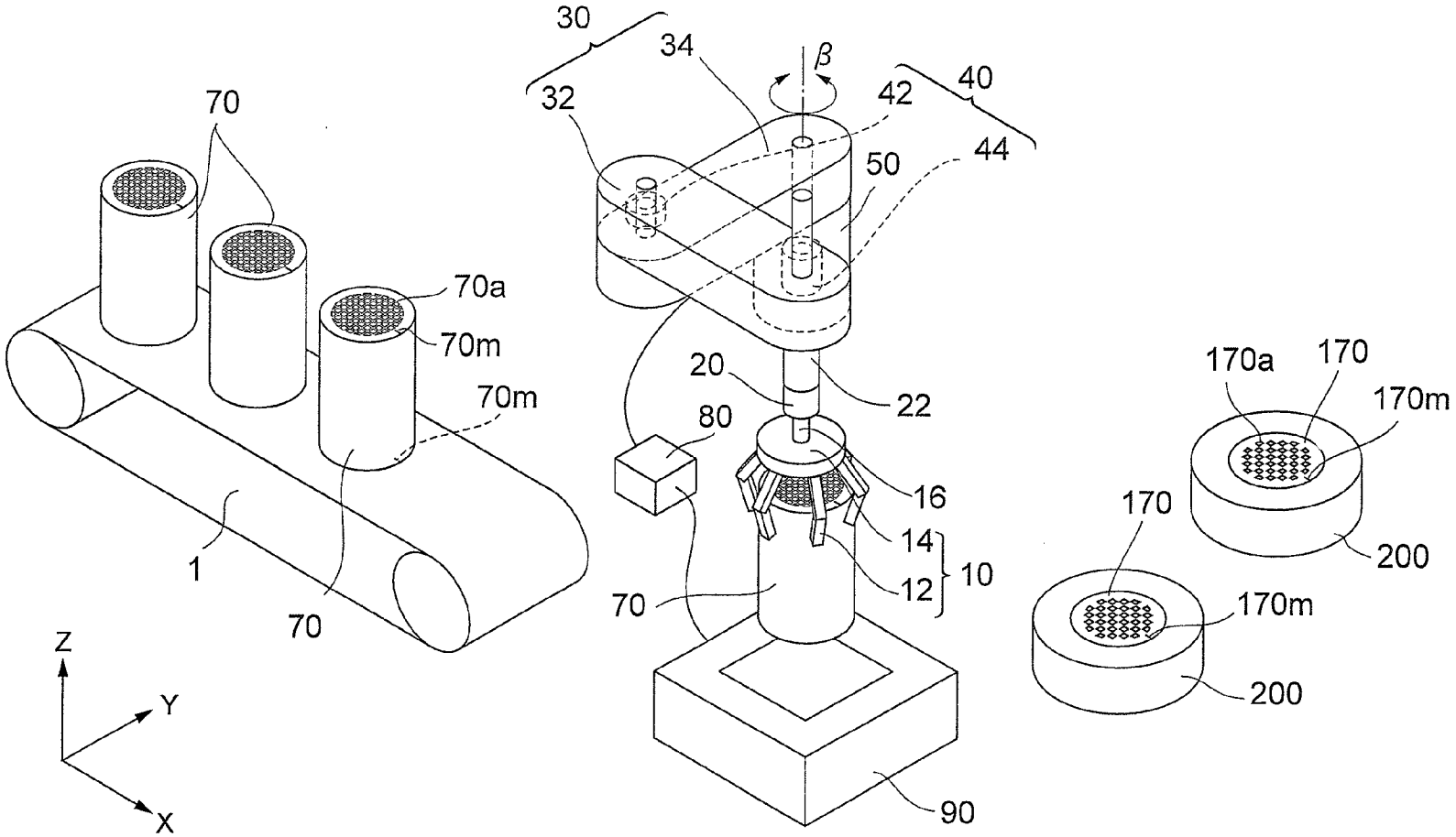
FIG. 5 is a perspective view continued from FIG. 1 and showing a method for plugging a honeycomb structure according to an embodiment.

Subsequently, the gripping and initial movement section 81 of the controller 80 gives an instruction to drive the arm 30 and the hand 10. The hand 10 thus grips one of the honeycomb structures 70 and then conveys the honeycomb structure 70 above the camera 90 as shown FIG. 5.

Then, the camera 90 takes an image of the end surface of the honeycomb structure 70.

Subsequently, based on the image from the camera 90, the initial rotation angle recognizing section 82 of the controller 80 recognizes the initial rotation angle θ of the honeycomb structure 70 gripped by the hand 10, around the vertical axis at the reference position where the image has been taken.

Figure 6:
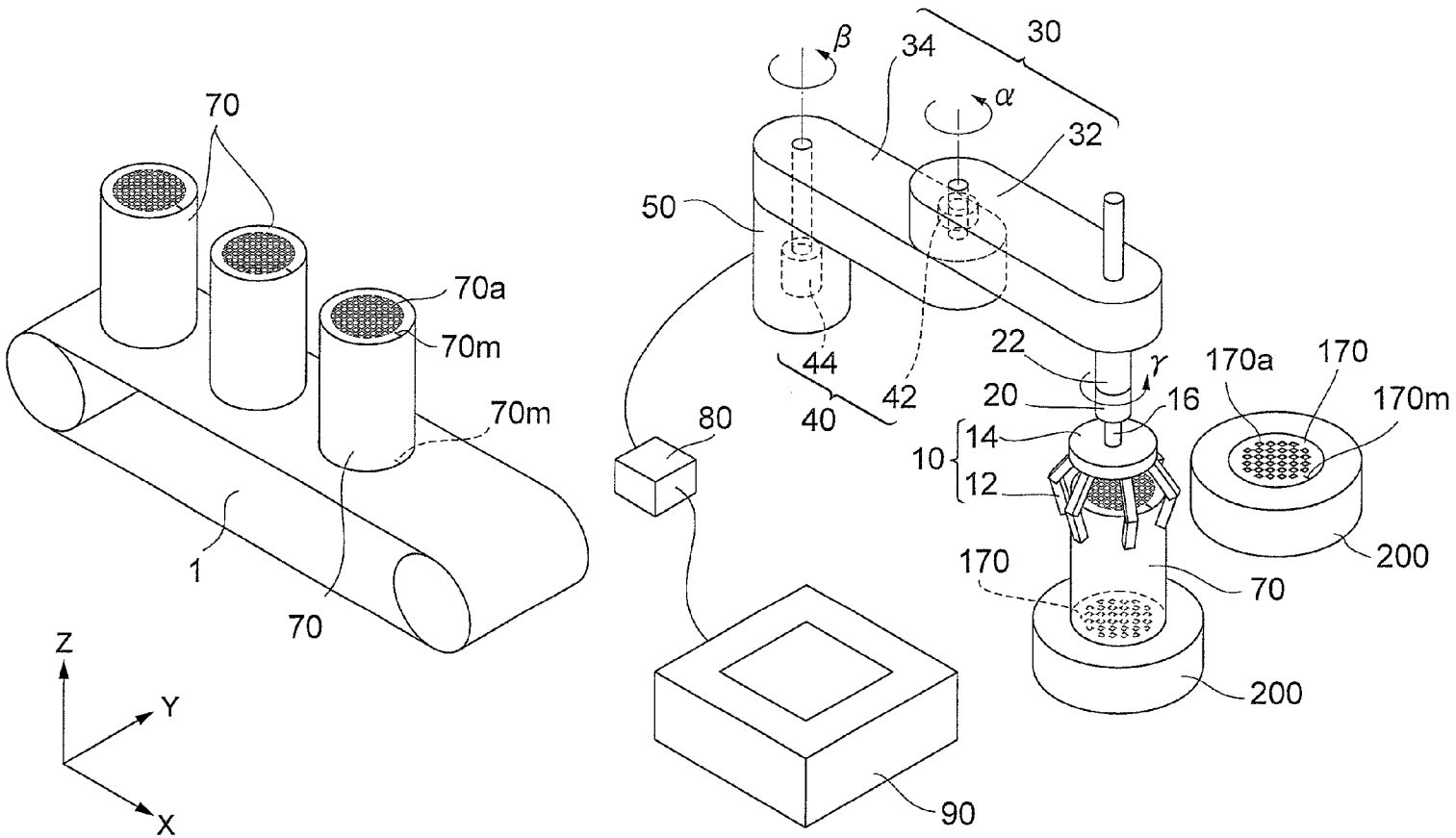
FIG. 6 is a perspective view continued from FIG. 5 and showing the method for plugging the honeycomb structure according to the embodiment.

Subsequently, the arm turning control section 83 of the controller 80 drives the arm turning section 40 to convey the honeycomb structure 70 gripped by the hand 10, from the reference position above the camera 90 to above the plugging mask 170, as shown in FIG. 6. For example, here, the second arm 32 is assumed to turn through the turning angle α, and the first arm 34 is assumed to turn through the turning angle β. The present embodiment involves a plurality of plugging apparatuses 200, and thus the honeycomb structure 70 may be conveyed to above the plugging mask 170 on the plugging apparatus 200 prepared for operation, as necessary.

Subsequently, the required rotation angle acquiring section 84 of the controller 80 acquires the hand rotation angle γ required to adjust the rotation angle of the honeycomb structure on the plugging mask 170 to the desired final rotation angle ϕ based on the initial rotation angle θ recognized at the reference position and the conveying rotation angle (α+β) of the honeycomb structure 70 around the vertical axis associated with the driving of the arm turning section 40 from the reference position to above the plugging mask 170. In the present example, the hand rotation angle γ is equal to ϕ−(θ+α+β).

Subsequently, the hand rotation control section 85 drives the hand rotation section 20 to rotate the honeycomb structure 70 based on the required hand rotation angle γ. Thus, the rotation angle of the honeycomb structure 70 on the plugging mask 170 is adjusted to the value ϕ. The alignment with the plugging mask 170 based on the rotation angle is then completed.

Subsequently, the post-process instructing section 86 drives the hand lifting and lowering section 22 and the hand 10 to lower the honeycomb structure 70 located above the plugging mask 170, onto the plugging mask 170. Moreover, the post-process instructing section 86 releases the honeycomb structure 70 from the hand 10 and loads the honeycomb structure 70 onto the plugging mask 170 (as shown in FIG. 4(*a*)). The honeycomb structure 70 may remain gripped by the hand 10 instead of being released from the hand 10.

Figure 4:
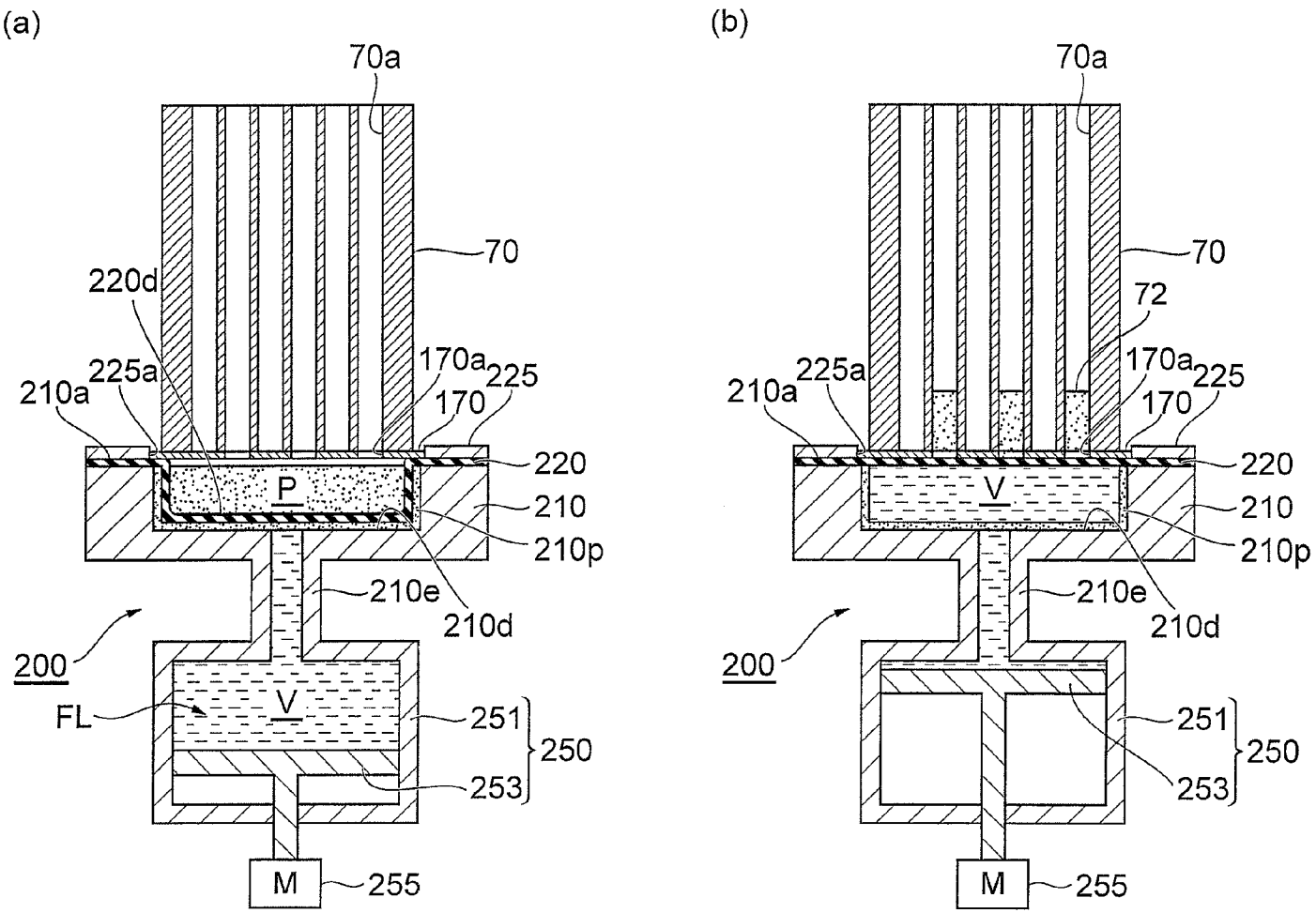
FIG. 4(*a*) is a schematic cross-sectional view showing the plugging apparatus, and FIG. 4(*b*) is a schematic cross-sectional view continued from FIG. 4(*a*) and showing an operation of the plugging apparatus.

Subsequently, as shown in FIG. 4(*b*), the piston of the pump 250 is moved upward to feed the fluid FL into the recess portion 210*d*, moving the elastic plate 220 toward the mask 170. Thus, the plugging material P is fed into some of the through-holes 70*a* in the ceramics honeycomb structure 70 via the through-holes 170*a* in the mask 170 to form plugged portions 72.

Subsequently, although not shown in the drawings, the piston 53 is further lifted to feed more fluid FL to between the elastic plate 220 and the main body portion 210, thus deforming the elastic plate 220 upward into a protruding shape to separate the elastic plate 220 from the ceramics honeycomb structure 70 and the mask 170. The following process may also be carried out as necessary. A reversing apparatus (not shown in the drawings) is used to turn the honeycomb structure upside down. A similar operation is then performed (setting a given initial rotation angle eliminates the need for image taking and the recognition of the initial rotation angle θ) to load the honeycomb structure 70 onto another plugging section 200. Then, the other surface of the ceramics honeycomb structure 70 is similarly plugged.

After the ceramics honeycomb structure 70 is plugged, the plugged ceramics honeycomb structure is dried and baked. The drying and baking allows a ceramics honeycomb filter to be completed. The ceramics honeycomb filter may be used, for example, as a diesel particulate filter.

At least two types of honeycomb structures may be plugged in order by the present apparatus by preparing a large number of plugging masks 170 of different types or forms and providing an apparatus for replacing the plugging mask 170 (not shown in the drawings).

According to the present embodiment, when the honeycomb structures 70 with different rotation angles are fed to above the plugging mask 170, the rotation angle of each of the honeycomb structures 70 can be easily adjusted to the desired value. Thus, the honeycomb structure 70 can be easily aligned with the plugging mask 170.

The conveying apparatus for the honeycomb structure, the method for plugging the honeycomb structure, and the method for manufacturing the honeycomb structure are not limited to the above-described embodiments but may be varied. For example, according to the above-described embodiments, the camera 90 is arranged away from the feeding apparatus 1. However, the bottom surface of the feeding apparatus 1 may be made transparent so that an image of the honeycomb structure 70 can be taken at a position where the honeycomb structure 70 on the feeding apparatus 1 is gripped by the hand 10.

According to the above-described embodiments, the hand rotating section 20 rotates the hand 10 based on the hand rotation angle γ after the honeycomb structure 70 is conveyed to above the plugging mask 170. However, the present invention is not limited to this configuration. For example, the hand rotating section 20 may rotate the hand 10 during or before the conveyance from the reference position to above the plugging mask 170. The hand rotating section 20 may rotate the hand 10 over any plural periods during or before the conveyance.

The arm 30 includes the second arm 32 and the first arm 34 which are capable of turning around the vertical axis. However, the first arm 34 may be exclusively provided and may include the vertical rotating shaft 16 and the hand 10. In this case, the hand rotation angle γ is, for example, ϕ−(θ+β). The present invention can be carried out even with at least three arms that are capable of turning around the vertical axis.

INDUSTRIAL APPLICABILITY

According to the conveying apparatus for the honeycomb structure, the method for plugging the honeycomb structure, and the method for manufacturing the honeycomb structure, the through-holes in the honeycomb structure can be easily and accurately aligned with the through-holes in the plugging mask. An image of the end surface of the honeycomb structure remaining gripped by the hand is taken, and the honeycomb structure is then moved to the plugging section. This enables a reduction in process time.

REFERENCE SIGNS LIST

10 . . . hand, 20 . . . hand rotating section, 30 . . . arm, 32 . . . second arm, 34 . . . first arm, 40 . . . arm turning section, 70 . . . honeycomb structure, 80 . . . controller, 82 . . . initial rotation angle recognizing section, 83 . . . arm turning control section, 84 . . . required rotation angle acquiring section, 85 . . . hand rotation control section, 90 . . . camera, 170 . . . plugging mask, 200 . . . plugging apparatus, 400 . . . conveying apparatus

The invention claimed is:

1. A conveying apparatus for a honeycomb structure, the apparatus comprising:

a hand that is capable of gripping the columnar honeycomb structure arranged in a vertical direction;

an arm that holds the hand at an end thereof;

an arm turning section that turns the arm around at least one vertical axis;

a hand rotating section that rotates the hand around the vertical axis with respect to the arm;

a camera that takes an image of an end surface of the honeycomb structure gripped by the hand;

an initial rotation angle recognizing section that recognizes, based on the image in the camera, an initial rotation angle of the honeycomb structure around the vertical axis at a reference position where the image has been taken;

an arm turning control section that drives the arm turning section to convey the honeycomb structure gripped by the hand from the reference position to above a plugging mask;

a required rotation angle acquiring section that acquires a hand rotation angle required to adjust the rotation angle of the honeycomb structure on the plugging mask to a desired final rotation angle whereby a predetermined set of through-holes in the honeycomb structure is aligned with a predetermined set of holes in the plugging mask, the final rotation angle being based on the initial rotation angle recognized at the reference position and a conveying rotation angle of the honeycomb structure around the vertical axis associated with the driving of the arm turning section from the reference position to above the plugging mask; and a hand rotation control section that drives the hand rotating section based on the required hand rotation angle to rotate the honeycomb structure.

2. The apparatus according to claim 1, wherein the arm comprises a first arm that is capable of turning around the vertical axis and a second arm that is capable of turning around the vertical axis with respect to the first arm, and the arm turning section turns the first arm and the second arm.

3. The apparatus according to claim 1, wherein the camera takes an image of a lower end surface of the honeycomb structure.

4. A method for plugging a honeycomb structure, the method comprising:

allowing a hand provided at an end of an arm to grip the columnar honeycomb structure arranged in a vertical direction;

taking an image of an end surface of the honeycomb structure gripped by the hand;

recognizing, based on the image, an initial rotation angle of the honeycomb structure around a vertical axis at a reference position where the image has been taken;

turning the arm around at least one vertical axis to convey the honeycomb structure gripped by the hand from the reference position to above a plugging mask;

acquiring a hand rotation angle required to adjust the rotation angle of the honeycomb structure on the plugging mask to a desired final rotation angle whereby a predetermined set of through-holes in the honeycomb structure is aligned with a predetermined set of holes in the plugging mask, the final rotation angle being based on the initial rotation angle recognized at the reference position and a conveying rotation angle of the honeycomb structure around the vertical axis associated with the conveyance from the reference position to above the plugging mask;

rotating the hand with respect to the arm based on the required hand rotation angle;

loading the honeycomb structure conveyed to above the plugging mask onto the plugging mask after the rotation of the hand; and feeding a plugging material to the honeycomb structure via the loaded plugging mask.

5. A method for manufacturing a honeycomb structure, the method comprising:

arranging the columnar honeycomb structure with at least one through-hole in a vertical direction;

allowing a hand provided at an end of an arm to grip the honeycomb structure arranged in a vertical direction;

taking an image of an end surface of the honeycomb structure gripped by the hand;

recognizing, based on the image, an initial rotation angle of the honeycomb structure around a vertical axis at a reference position where the image has been taken;

turning the arm around at least one vertical axis to convey the honeycomb structure gripped by the hand from the reference position to above a plugging mask;

acquiring a hand rotation angle required to adjust the rotation angle of the honeycomb structure on the plugging mask to a desired final rotation angle based on the initial rotation angle recognized at the reference position and a conveying rotation angle of the honeycomb structure around the vertical axis associated with the conveyance from the reference position to above the plugging mask;

rotating the hand with respect to the arm based on the hand rotation angle;

loading the honeycomb structure conveyed to above the plugging mask onto the plugging mask after the rotation of the hand;

feeding a plugging material to the honeycomb structure via the loaded plugging mask; and a step of drying the honeycomb structure.

6. The method for manufacturing the honeycomb structure according to claim 5, wherein in acquiring the hand rotation angle, the hand rotation angle is acquired based on a difference between the desired final rotation angle and a combined value of the initial rotation angle and the conveying rotation angle.

7. The method for manufacturing the honeycomb structure according to claim 5, wherein in feeding the plugging material, the plugging material is fed exclusively to though-holes which lie opposite the holes in the plugging mask, of the plurality of through-holes in the honeycomb structure.

8. The method for manufacturing the honeycomb structure according to claim 5, wherein the step of rotating the hand is carried out after conveying the honeycomb structure to above the plugging mask.

9. The method for manufacturing the honeycomb structure according to claim 5, wherein rotating the hand is carried out during the step of conveying the honeycomb structure to above the plugging mask.

10. The method for manufacturing the honeycomb structure according to claim 5, wherein rotating the hand is carried out before the step of conveying the honeycomb structure to above the plugging mask.

11. The method for manufacturing the honeycomb structure according to claim 5, wherein, prior to drying the honeycomb structure, the structure is oriented in the vertical direction, and wherein said drying is performed by baking the honeycomb structure.

* * * * *